US006551205B1

(12) United States Patent
Koelzer, Jr. et al.

(10) Patent No.: US 6,551,205 B1
(45) Date of Patent: Apr. 22, 2003

(54) ELECTRONIC TARGET FOR SENSING THE IMPACT OF OBJECTS

(75) Inventors: Joseph Henry Koelzer, Jr., Burnet, TX (US); Mary Elizabeth Koelzer, Burnet, TX (US)

(73) Assignee: Excel Sports, Inc., Burnet, TX (US)

( * ) Notice: Subject to any disclaimer, the term of this patent is extended or adjusted under 35 U.S.C. 154(b) by 0 days.

(21) Appl. No.: 08/890,185

(22) Filed: Jul. 9, 1997

Related U.S. Application Data

(60) Provisional application No. 60/021,686, filed on Jul. 10, 1996.

(51) Int. Cl.[7] ..... A63B 63/00
(52) U.S. Cl. ..... 473/454
(58) Field of Search ..... 473/454–456, 473/476, 570, 571; 273/331, 333, 334, 348, 372; 340/323 R

(56) References Cited

U.S. PATENT DOCUMENTS 4,210,326 A * 7/1980 Booth et al. ..... 273/127 R
4,390,181 A 6/1983 Parish ..... 273/26
4,770,527 A * 9/1988 Park
4,830,369 A * 5/1989 Poitras ..... 273/26 A
4,995,607 A * 2/1991 Whitfield ..... 473/454
5,222,731 A * 6/1993 Hanabusa et al.
5,401,016 A * 3/1995 Heglund et al. ..... 473/455
5,419,549 A * 5/1995 Galloway et al. ..... 273/374
5,419,565 A * 5/1995 Gordon et al. ..... 273/374
5,478,077 A * 12/1995 Miyahara
5,509,649 A 4/1996 Buhrkuhl ..... 273/26 A
5,553,846 A * 9/1996 Frye et al. ..... 273/26 C
5,553,860 A * 9/1996 Zelikovich ..... 273/371
5,566,934 A * 10/1996 Black et al.
5,573,239 A * 11/1996 Ryker et al.
5,602,638 A * 2/1997 Boulware
5,658,211 A * 8/1997 Glover ..... 473/422
5,779,241 A * 7/1998 DeCosta et al. ..... 273/26 A
5,820,496 A * 10/1998 Bergeron
5,846,139 A * 12/1998 Bair et al.

* cited by examiner

*Primary Examiner*—Michael O'Neill
(74) *Attorney, Agent, or Firm*—Kelly K. Kordzik; Winstead Sechrest & Minick P.C.

(57) ABSTRACT

A target detects the location of an impact of an object against a material by using various sensors. One utilization of the target is for a baseball or softball target whereby strikes and balls are detected depending upon the location of the impact of the ball against the target. The determination of the strikes and the balls is then provided to the thrower of the ball using some type of output device.

4 Claims, 8 Drawing Sheets

ELECTRONIC TARGET FOR SENSING THE IMPACT OF OBJECTS

CROSS-REFERENCE TO RELATED APPLICATION

This application is a continuation-in-part of U.S. Provisional Patent Application Serial No. 60/021,686, filed Jul. 10, 1996.

TECHNICAL FIELD

The present invention relates in general to a target, and in particular, to an electronic target for sensing the occurrence of one or more events.

BACKGROUND INFORMATION

When a person wishes to practice pitching a baseball or softball (hereinafter the discussion will be with respect to a baseball, but will also be applicable to a softball), that person generally needs another person to catch the ball and return it. Alternatives to this arrangement are to pitch an elastic ball, such as a tennis ball, against a wall so that the ball bounces back to the thrower, or to throw a baseball at a netting material stretched over a frame so that when the ball hits the netting material, it bounces back to the thrower.

The problem with these two alternatives is that it is difficult to determine whether or not the pitcher throwing the ball is accurately throwing "strikes" or is instead throwing "balls".

With today's busy world, it is sometimes difficult for children learning to play baseball to find a partner to pitch to in order to hone the pitcher's pitching skills. Therefore, what is needed in the art is some type of baseball target that allows one person to pitch at the target with baseballs, where the target provides some type of indication of the accuracy of the baseballs being thrown at the target and provides a determination of balls and strikes.

SUMMARY OF THE INVENTION

The present invention satisfies the foregoing needs by providing a target having sensors arranged thereon so that when the target is struck with an object such as a baseball or softball, it provides a determination of the accuracy of the ball pitched against the target. In other words, the target includes a defined area for strikes. The area of the target outside of this defined boundary will record a ball when struck by the baseball.

The sensors then transmit the ball and strike information in several ways so that the thrower is provided this information. One way is for a display to be coupled to the sensors where the display provides an indication of the number of balls and strikes recorded by the sensors when the target is struck with a baseball.

In another embodiment of the present invention, a speaker is provided with voice-processing circuitry so that the thrower of the baseball is told with an electronic voice whether or not the ball thrown is a ball or a strike.

Yet another embodiment of the present invention provides for a transmission of the information from circuitry located at the target to a display located near where the pitcher or thrower is standing. Such information can be transmitted by electronic wire or by some other type of signalling such as RF signals or light signals.

In yet another embodiment of the present invention, signals are transmitted to a beeper-sized receiver, which may be attached to the pitcher's belt or pocket, where the strike and ball information is spoken to the thrower using voice-processing circuitry.

As an alternative embodiment, instead of providing an ability to sense the impact of an object, the principals of the present invention could be utilized with sensors that detect the passing of an object through a particular area or plane.

Furthermore, the present invention can be extended to serve as a target for other sports, including, but not limited to, kick ball, soccer, basketball, tennis, racquetball, handball, volleyball, etc. In fact, any sport in which there is required some degree of accuracy in performance could make use of the principles of the present invention.

And still further, the principles of the present invention can be extended to any situation where there is a need to spacially discriminate between any two events.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
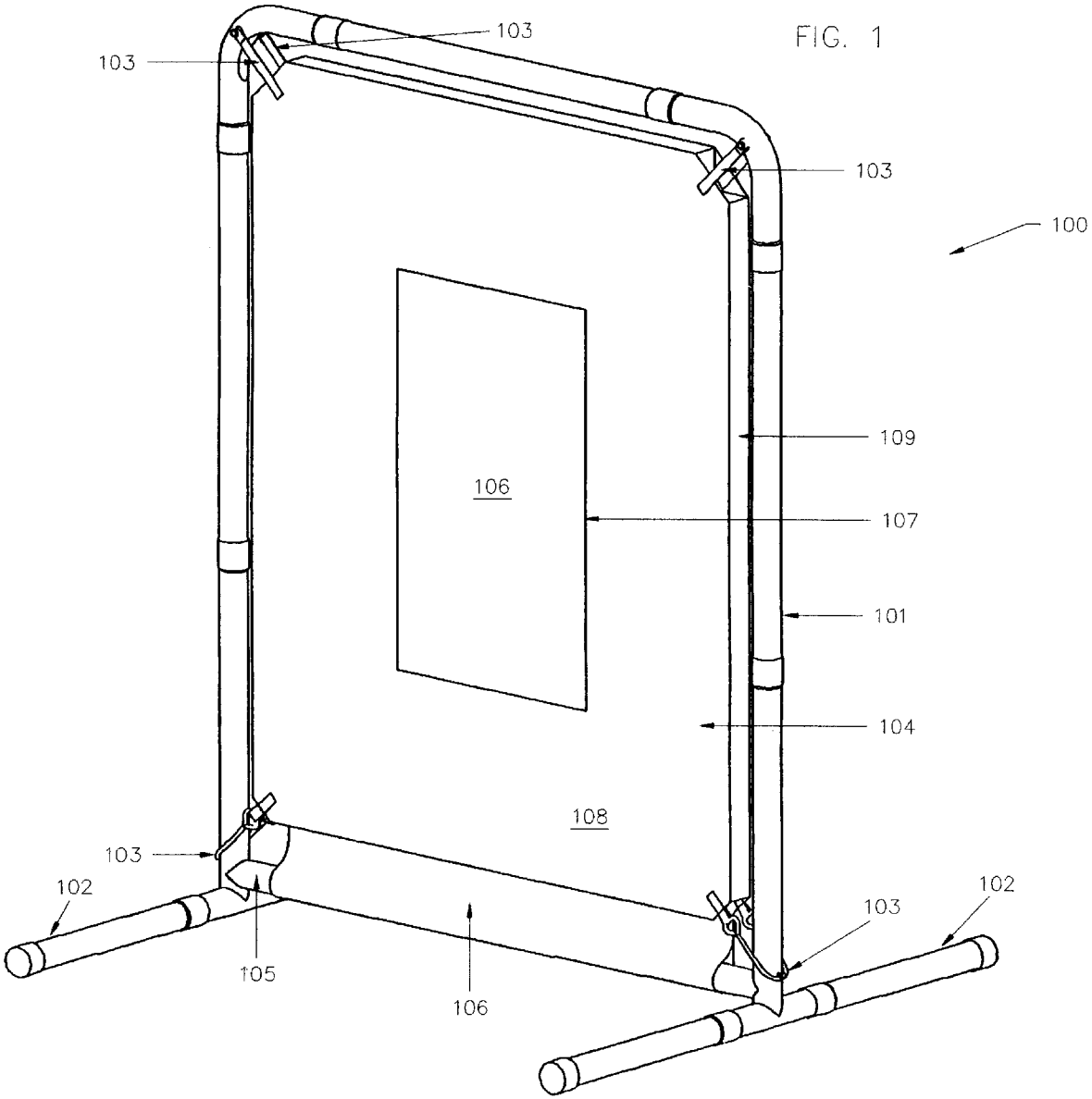
FIG. 1 illustrates a perspective view of the present invention.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Refer now to the drawings wherein depicted elements are not necessarily shown to scale and wherein like or similar elements are designated by the same reference numeral through the several views.

FIG. 1 illustrates a perspective view of one embodiment of the present invention. The view of target 100 is from the front, which will receive objects, such as baseballs directed at it. In one embodiment, two parallel planes of flexible vinyl-type material are utilized to house sensors described below, in order that objects directed at mat 104, such as a baseball, can be detected, and the locations where the object strikes mat 104 can be discerned. Note that mat 104, comprising strike plane 106 and ball plane 108 does not necessarily have to be made out of a flexible material. A more durable, non-flexible material such as sheet metal could also be utilized, or some other equivalent.

Ball plane 108, which is located slightly in front of strike plane 106 is spaced apart from strike plane 106. Ball plane 108 has cut-out 107 therethrough so that the baseball can pass through ball plane 108 to strike plane 106 if the ball is thrown accurate enough to hit strike plane 106.

The assembled mat 104 is coupled to frame 101 using straps 103. Frame 101 may include some means for standing it up vertically, such as legs 102. The material utilized to manufacture frame 101 and legs 102 are immaterial to the understanding of the present invention.

Since strike plane 106 and ball plane 108 are spaced apart a specified distance, a ball entering through cut-out 107 and impacting strike plane 106 may be permitted to fall between planes 106 and 108 and exit below ball plane 108 in front of cross bar 105 over which strike plane 106 has been extended.

Though the material utilized to manufacture strike plane 106 may be of any size, it is preferable that the size of strike plane 106 be at least as large as cut-out 107 in order to stop the travel of any ball impacting strike plane 106. In one embodiment of the present invention, for ease of manufacturing the entire mat 104, strike plane 106 is made of a material essentially the same size as ball plane 108.

Figure 2:
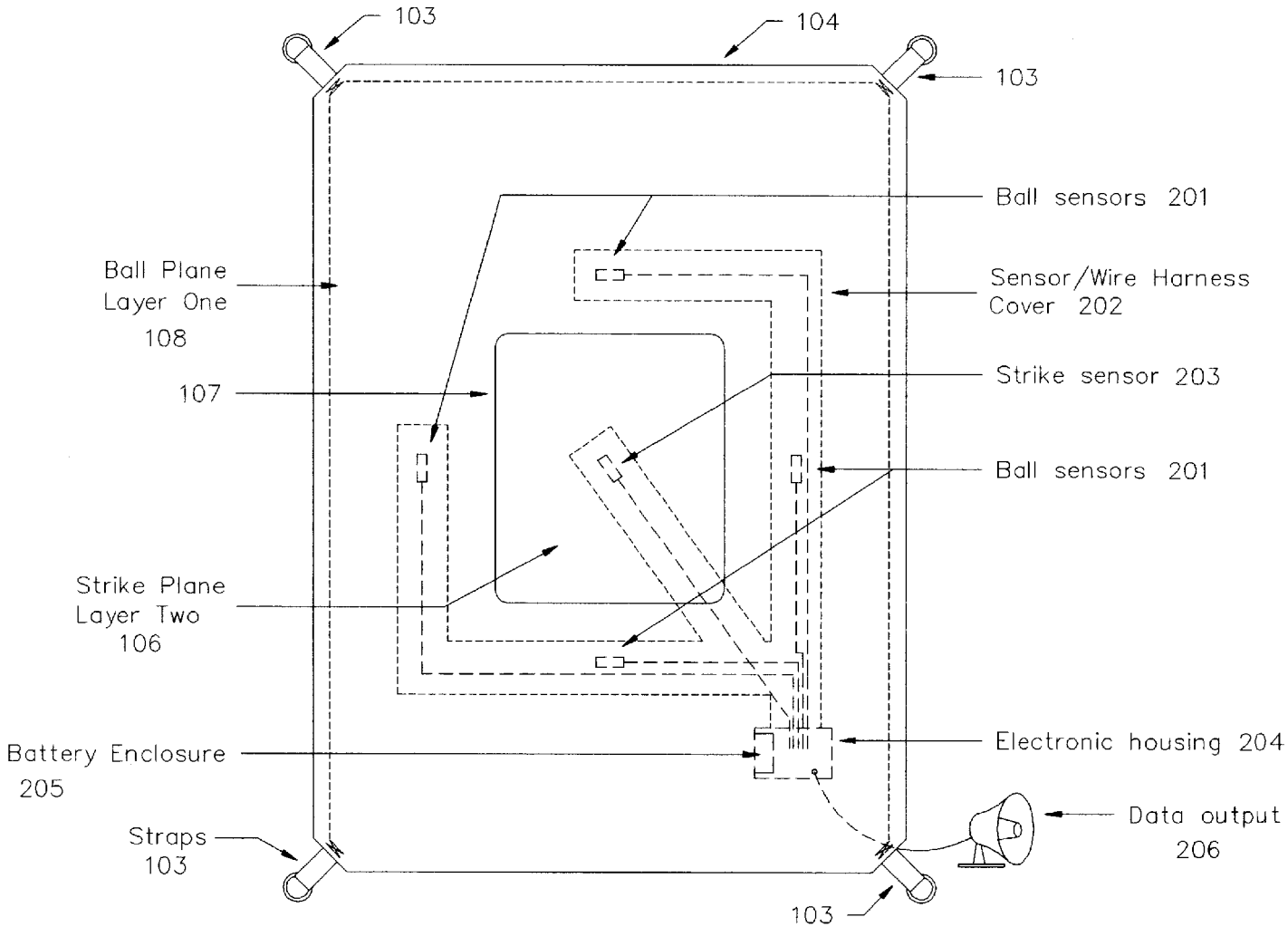
FIG. 2 illustrates an assembled view of the present invention.

Referring next to FIG. 2, there is illustrated an assembled view of target mat 104 without frame 101 shown. Also illustrated is the placement of ball and strike sensors and other electronic equipment utilized to sense a relative location of an object striking mat 104.

The view of mat 104 is from the front, so therefore ball plane layer 108 is shown with cut-out 107 so that strike plane layer two 106 can be seen through cut-out 107. In the embodiment shown, ball sensors 201 are located on the back side of ball plane 108, while strike sensor 203 is located on the back side of strike plane 106.

Shown are four ball sensors 201 and one strike sensor 203. However, the present invention can be implemented with any number of sensors for both the strikes and the balls. Furthermore, the location of the sensors shown is not critical to the present invention. One skilled in the art could experiment with the location of the ball sensors 201 or strike sensors 203 in order to achieve certain accuracies.

Ball sensors 201 and strike sensor 203 are electronically coupled by a wiring harness to electronic housing 204, whose contents will be described in further detail below. Power may be supplied to electronic housing 204 with a battery within battery enclosure 205, or through some other type of power means, such as an AC current. Ball sensors 201 and strike sensor 203 and their associated wiring harnesses may be attached to ball plane 108 and strike plane 106 in their respective manners by sensor/wire harness cover 202, which provides some type of protection from the elements for the sensors and their associated electronic wiring.

Please also note that the size of cut-out 107, and/or the relative sizes of the ball and strike zones can be adjusted to any desired sizes.

Sensors 201 and 203 may be piezo film sensors; however, other types of sensors could be used. Piezo film sensors are manufactured in a variety of sizes and shapes, many of which would work in the present invention. Piezo sensors discharge a voltage when they are moved (bent). This is often referred to as a "self-excited circuit." As an example, piezo sensors manufactured by AMP as model no. AMP P/N 1-1001881-0 REV F or P/N 0-1002794-1 P could be utilized. Such sensors sense a physical wave caused within the fabrics of the respective ball plane and strike plane. However, other types of sensors could be used. For example, the use of microphone sensors could be substituted to sense the impact sound rather than the wave of the impact. Additionally, the sensors could be replaced with some type of sensor for detecting the breaking of a plane of light instead of the contact of an object against a material.

In this embodiment illustrated in FIG. 2, the strike zone is implemented with one plane 106 while the ball plane is implemented with a second plane 108. Note that the present invention may be implemented with a single plane, discussed in further detail below with respect to FIG. 5. Furthermore, the present invention could be implemented with more than two planes: for example, in order to detect and discern between the occurrence of more than two different events. As an example, a third plane (not shown) with specified sensors could be positioned behind strike plane layer two 106, and cut-outs (not shown) could be formed through layers 106 and 108 to allow the passage of an object, such as a baseball through those cut-outs in order to strike the third plane. This concept can be extended to further numbers of planes.

Shown in FIG. 2 is a speaker serving as the receiver of the data output 206 from electronic housing 204. Use of data output 206 is further described below.

Figure 3:
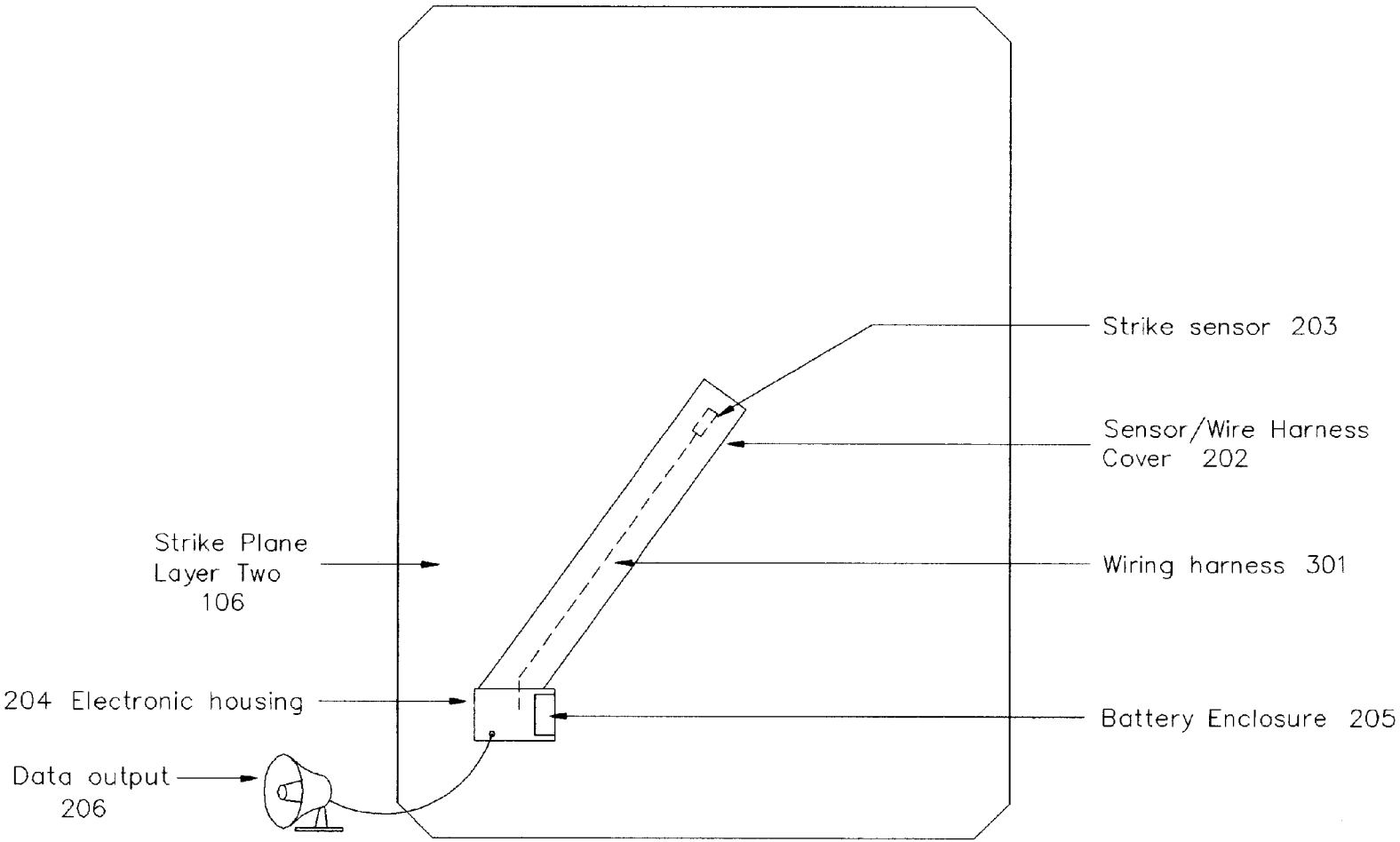
FIG. 3 illustrates a rear view of the strike plane of the present invention.

Referring next to FIG. 3, there is illustrated a rear view of strike plane 106. This illustration provides a view of the implementation of the strike plane with strike sensor 203, harness cover 202, wiring harness 301, battery enclosure 205, electronic housing 204, and data output 206.

Figure 4:
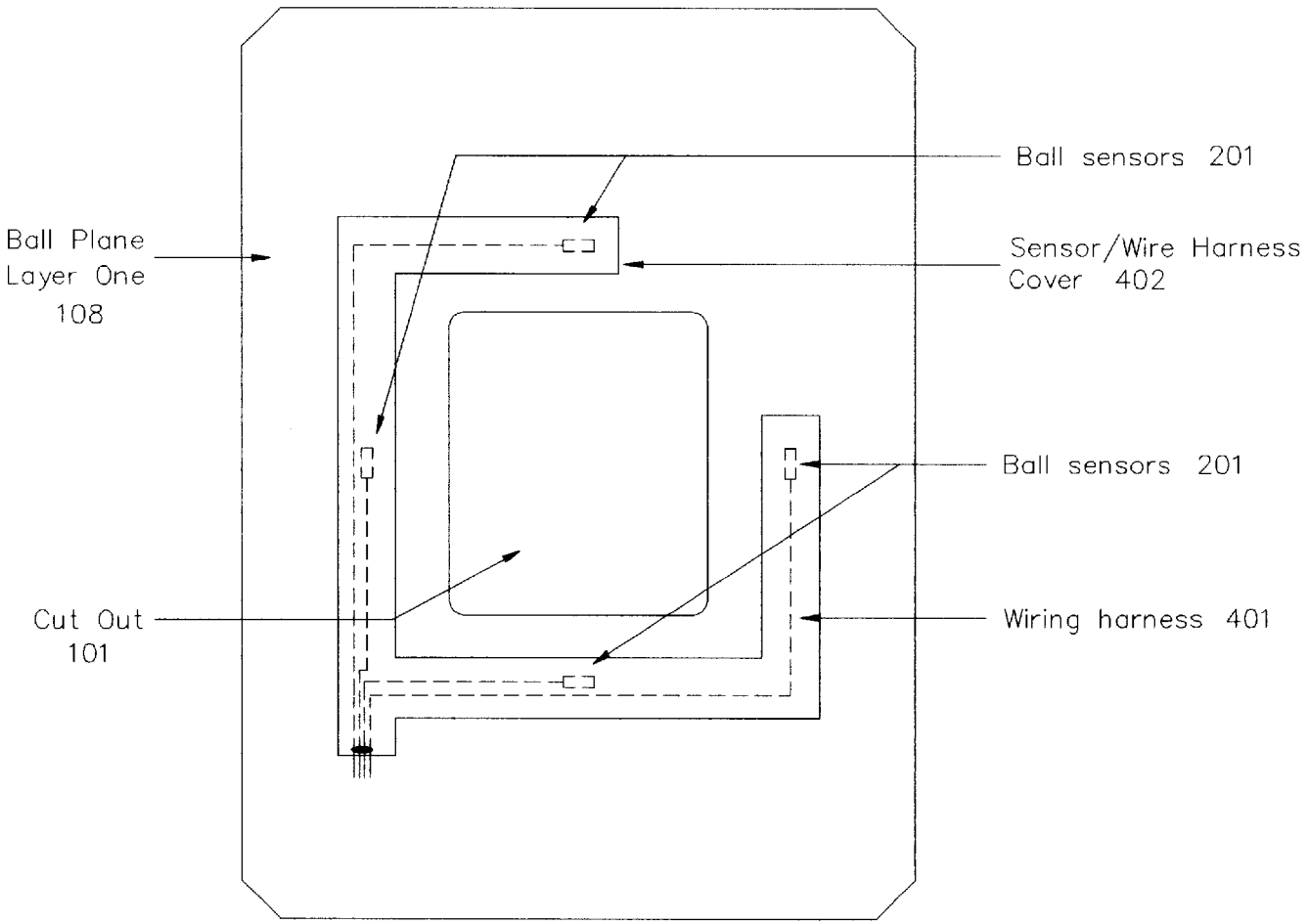
FIG. 4 illustrates a rear view of the ball plane of the present invention.

Referring next to FIG. 4, there is illustrated a rear view of ball plane 108, without the illustration of electronic housing 204, battery enclosure 205 and data output 206. Wiring harness 401 encompassing the various electronic circuitry emanating from ball sensors 201 may be coupled to electronic housing 204, which in this embodiment as shown in FIG. 3 is physically coupled to strike plane 106.

Referring to FIGS. 1–4, the concept of the present invention is that when an object, such as a baseball, impacts anywhere on ball plane 108, the impact of the ball on the material comprising ball plane 108 will cause one or more of ball sensors 201 to detect the impact. In contrast, if the ball passes through cut-out 107, it will not impact ball plane 108, but instead will impact strike plane 106, which will cause strike sensor 203 to detect the impact.

If the present invention makes use of flexible materials for one or both of the planes 106 and 108, then when a ball impacts one of the planes, it is very likely that there will be some type of vibration set up within the other plane. However, the plane which receives the actual impact, will have a wave traveling through it that is greater than the wave caused in the other plane where the impact did not occur. As a result, though the electronics described below may receive signals from both the ball sensors 201 and the strike sensor 203, the sensor which receives the greater amplitude wave will be the one that determines the selection of the data output 206.

Figure 5:
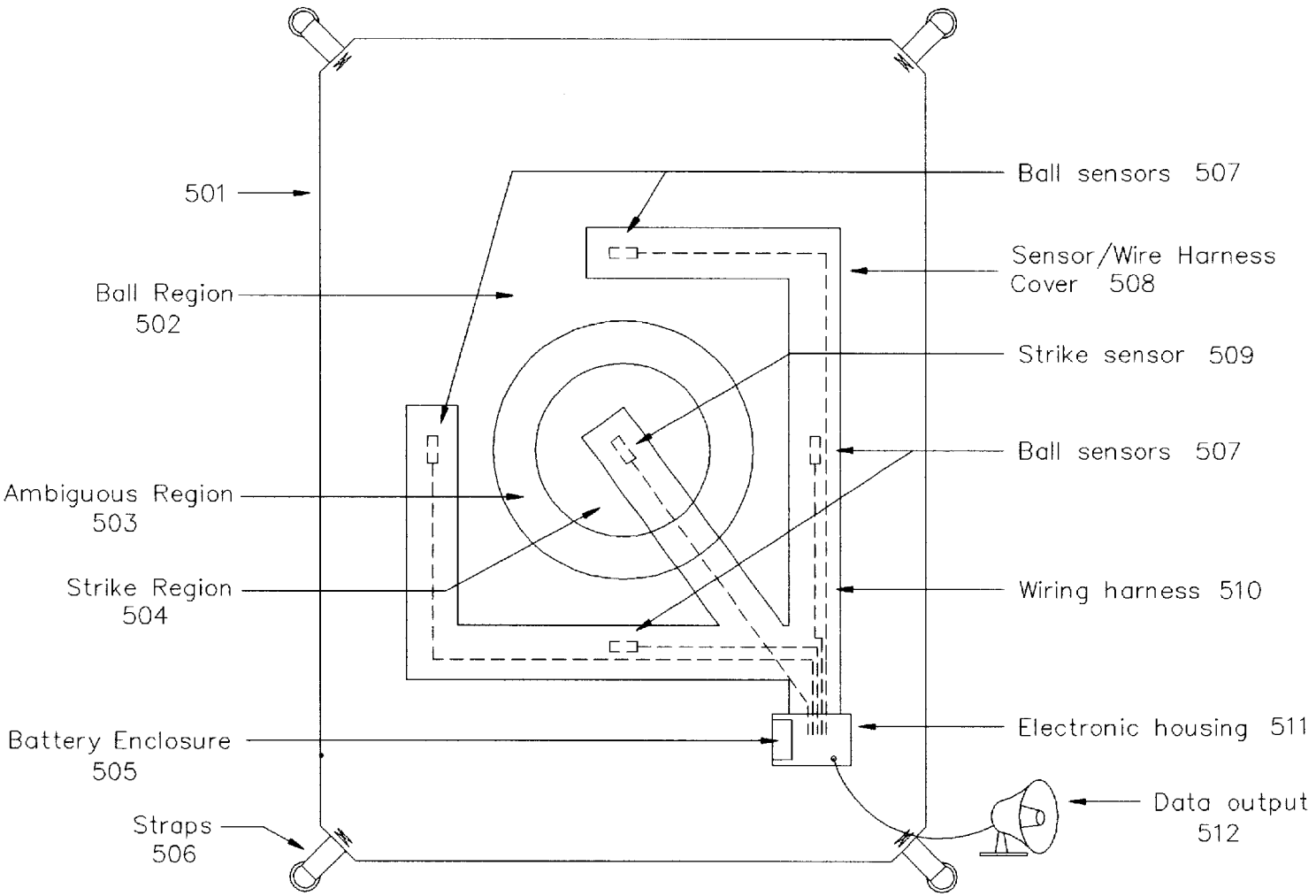
FIG. 5 illustrates an alternative embodiment of the present invention.

Referring next to FIG. 5, there is illustrated an alternative embodiment of the present invention where only a single plane of material 501 is utilized. Straps 506 correspond to straps 103. Furthermore, battery enclosure 505, electronic housing 511, ball sensors 507, strike sensor 509, harness cover 508, harness 510 and data output 512 correspond to their counterparts described above with respect to FIGS. 1–4. However, since ball sensors 507 and strike sensor 509 are located on the same plane of material, the electronics attached to sensors 507 and 509 will discern between some physical waves set up in the material 501 that are much closer in amplitude. Essentially, when an object impacts mat 501 near strike sensor 509 within strike region 504, a strike will be detected. Likewise, ball region 502 is the region of mat 501 where the impact of a ball will be detected as a ball. Note that there may be an ambiguous region 503 where the system may have difficulty discerning between balls and strikes. However, in some applications, this may be desirable for more accurately simulating the balls and strikes called by a human umpire.

Furthermore, electronics receiving signals from sensors 507 and 509 may be programmed to decide between balls and strikes as a function of the timing of waves received by the various sensors 507 and 509. In other words, the sensor that receives a wave above a specified amplitude threshold first will be the sensor that determines whether or not a ball or strike is outputted.

Figure 6:
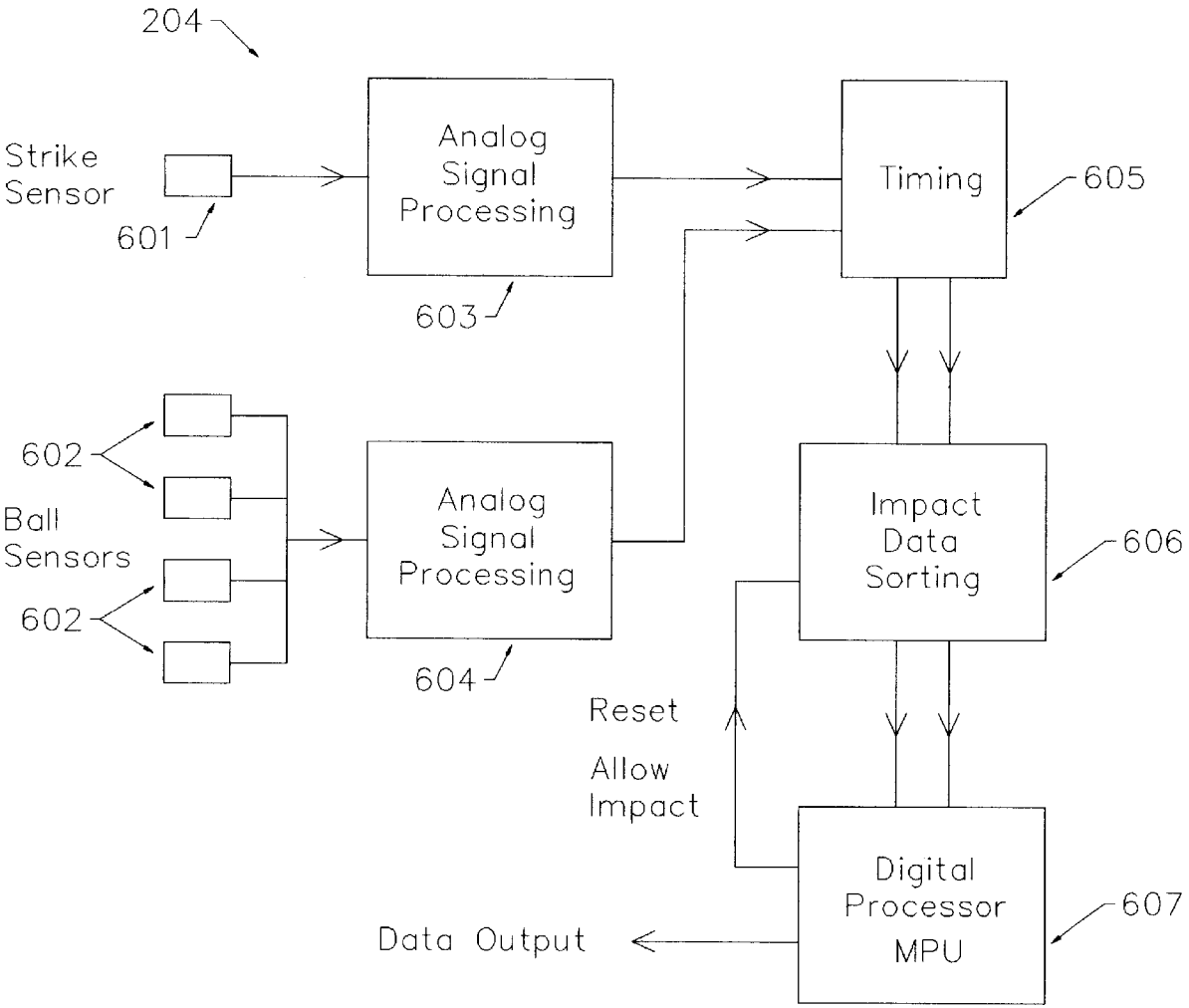
FIG. 6 illustrates a block diagram of the electronics utilized within the present invention.

Referring next to FIG. 6, there is illustrated a block diagram of a portion of the electronics utilized within the present invention. Strike sensor 601 is electronically coupled to analog signal processing circuitry 603, while ball sensors 602 are coupled to analog signal processing circuitry 604. Blocks 603 and 604 measure the amplitude of the received signals. Outputs from block 603 and 604 are provided to timing circuitry 605. Block 603 will output a signal if the signal received from strike sensor 601 is above a specified amplitude. Block 604 will output a signal if one or more signals from ball sensors 602 are above a specified amplitude. Timing circuitry 605 receives one or both of the signals from block 603 and 604. The first of these signals to be received by timing circuitry 605 "wins"; in other words, if a strike signal from block 603 is received before a ball signal from block 604, then timing circuitry 605 will latch the strike signal, which will then be passed to impact data sorting circuitry 606, which will then ignore any other signals from timing circuitry 605 until a reset signal is received from microprocessor 607.

Furthermore, timing circuitry 605 may insert one or more delays for either or both of the signals received from blocks 603 and 604. For example, delays may be required to compensate for the various distances between the individual sensors and the electronics. Furthermore, since all of ball sensors 602 are received by analog signal processing 604, there may be additional electronic circuitry, such as multiplexers and OR gates, through which signals received from ball sensors 602 may have to travel as opposed to signals received from the single strike sensor 601. As a result, delay circuitry may be needed to compensate for the additional circuitry implemented.

The output from block 606 (strike or ball) is transmitted to digital microprocessor unit 607, which then outputs a data output. Digital microprocessor unit 607 receives the signal from block 606 and determines what data output should be sent. In one embodiment, this data output may comprise a message or messages that should be played by a voice chip.

When a ball strikes anywhere on mat 104, all the sensors will record some level of activity. The spacing and placement of the sensors ensures that the closest sensor to the impact is recorded first. This placement is a function of the speed at which the plane wave caused by the impact of the ball on the target moves through the material of the target. There may also be bounce-back waves that are considered. Bounce-back waves occur when the original wave reaches the end of the target material and bounces back. If compensation for bounce-back waves is not provided, there may be dead zones in the target relative to the sensors. Such a compensation may be the implementation of some type of threshold whereby one or more of sensors does not send a signal if the detected plane wave is not of a sufficient amount of amplitude.

Note that microprocessor 607 may also accumulate strikes and balls in a pre-programmed manner.

Figure 7:
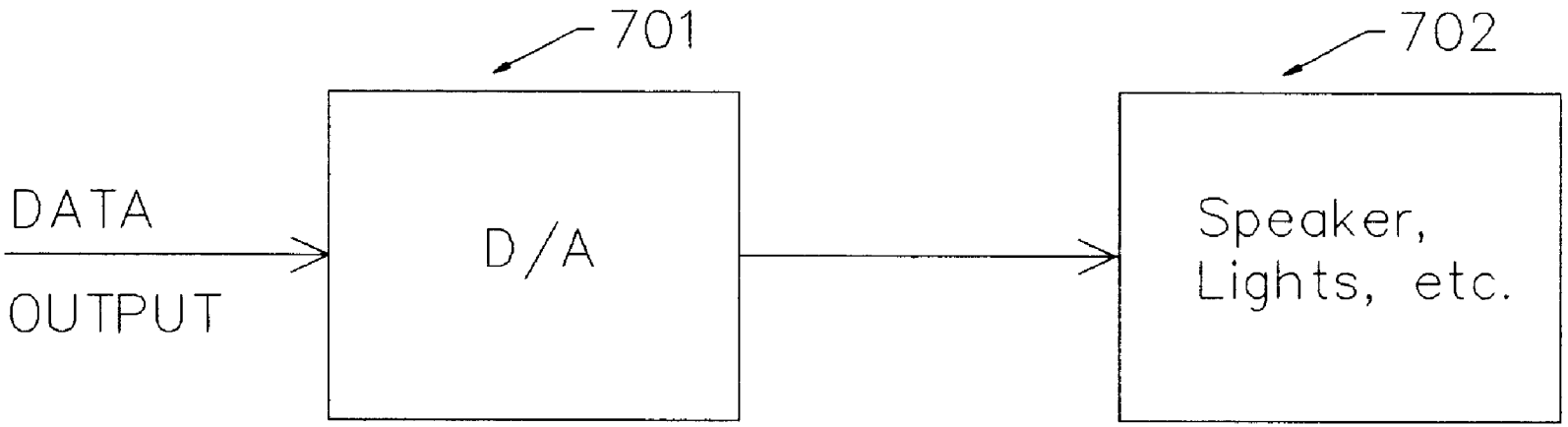
FIG. 7 illustrates utilization of the output of the present invention.

Referring next to FIG. 7, there is illustrated one embodiment for utilizing the data output from microprocessor 607. The data output is converted by digital-to-analog (D/A) converter 701 to an analog form for use by an output means 702, such as a speaker, an LED display, a selection of lights for indicating strikes and balls, or any other type of output means for informing a user of their efforts.

Figure 8:
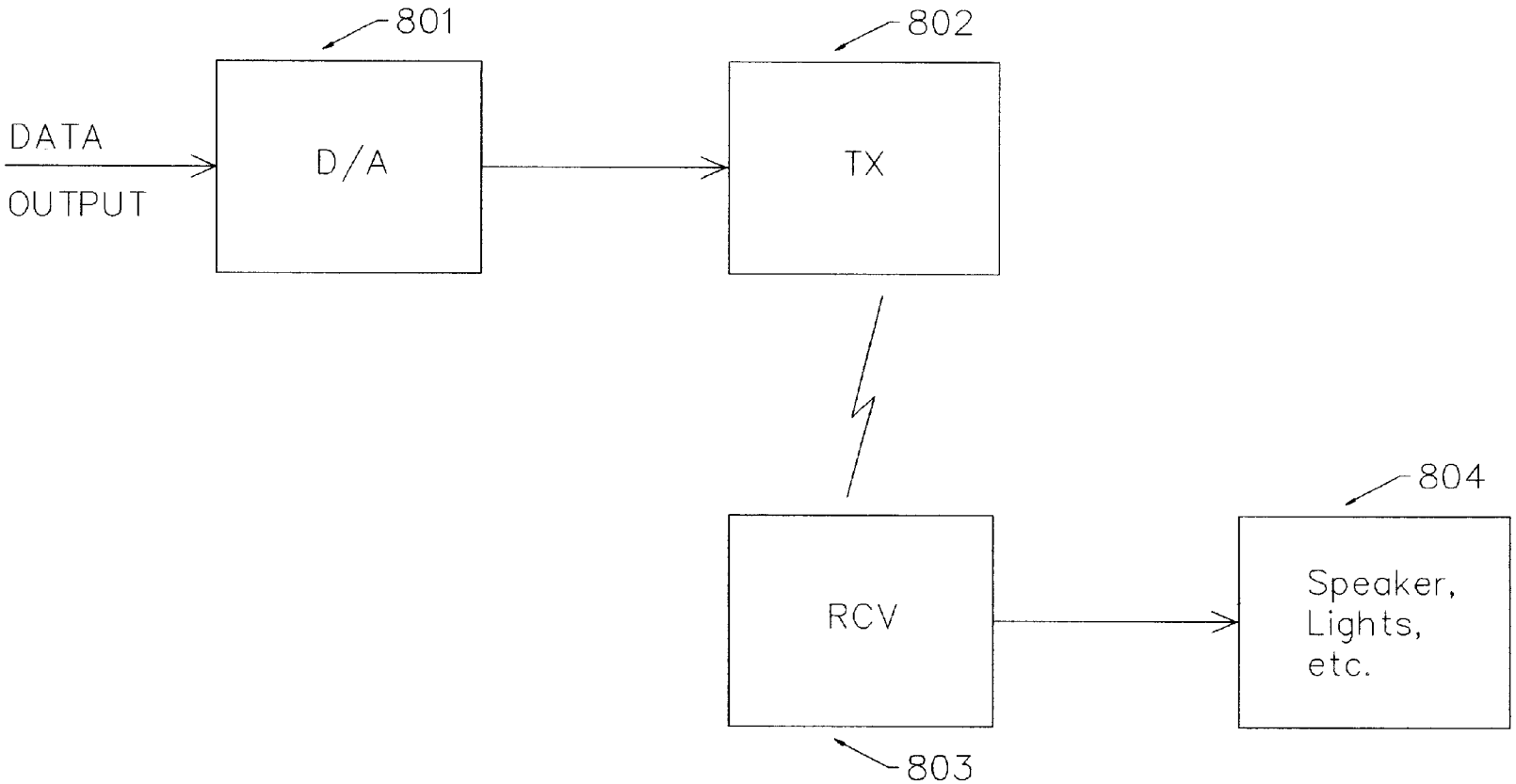
FIG. 8 illustrates transmission of the output of the present invention.

Referring to FIG. 8, there is illustrated an alternative embodiment whereby the data output is converted to an analog form by digital-to-analog converter 801 and then transmitted by transmitter 802 to receiver 803, which then provides the signal to the output means 804, which may be any one of the output means described above with respect to FIG. 7. Some type of signal processing circuitry may be implemented between receiver 803 and output means 804. The transmission of the information may be made by RF, infrared, microwave, landline, fiber optic, or other means. As one example, the user may have a beeper-like transceiver on their belt, which has a speaker for stating the "strikes" and "balls" as determined by the system described above with respect to FIG. 6.

Although the present invention and its advantages have been described in detail, it should be understood that various changes, substitutions and alterations can be made herein without departing from the spirit and scope of the invention as defined by the appended claims.

What is claimed is:

1. An apparatus comprising:

a target having one or more designated areas; and circuitry operable for notifying a user when a moving object is in proximity to the one or more designated areas, wherein the moving object has been thrown by the user at the target, wherein the target comprises one or more surfaces having the one or more designated areas, wherein the notifying circuitry includes one or more sensors operable for detecting which of the one or more designated areas is nearest in proximity to the object, wherein the one or more sensors detect an impact of the object on one of the one or more surfaces, wherein one or more sensors are piezo film sensors, wherein the one or more surfaces include first and second parallel mats of flexible material mounted in a frame, wherein the first mat has a hole there through providing access to the second mat, wherein the first mat includes the first designated area and the second mat includes the second designated area, wherein an impact of the object in proximity to the second designated area occurs when the object passes through the hole and impacts the second mat.

2. An apparatus, comprising:

a plurality of planes, wherein each of said plurality of planes is spaced apart in a substantially horizontal direction;

at least one sensor in communication with each of said plurality of planes;

circuitry operable for discriminating which sensor is closest to an impact location where an object contacts one or more of said plurality of planes;

circuitry operable for identifying a plane in communication with said sensor closest to said impact location; and circuitry operable for notifying a user of said apparatus which plane has been contacted.

3. The apparatus as recited in claim 2, wherein one of said plurality of planes has a cut-out.

4. The apparatus as recited in claim 3, wherein a ball entering said cut-out falls between said plurality of planes.

* * * * *